United States Patent [19]

Chavez et al.

[11] Patent Number: 4,865,225

[45] Date of Patent: Sep. 12, 1989

[54] UNIVERSAL DRIP CATCHER

[75] Inventors: Frank J. Chavez, La Habra; John A. Bell, Long Beach, both of Calif.

[73] Assignee: McKesson Corporation, Los Angeles, Calif.

[21] Appl. No.: 146,411

[22] Filed: Jan. 21, 1988

[51] Int. Cl.[4] ..... B67D 1/16

[52] U.S. Cl. ..... 222/108; 141/86; 248/558

[58] Field of Search ..... 222/108–111, 222/318, 129.1, 173, 180; 141/86–88, 311 A; 137/312–314; 248/220.2, 223.4, 224.2, 558

[56] References Cited

U.S. PATENT DOCUMENTS

| | | | |
|---|---|---|---|
| 166,889 | 8/1875 | Porter | 222/108 |
| 1,720,309 | 7/1929 | Wakefield | 248/223.4 X |
| 2,003,050 | 5/1935 | Iselin | 222/131 |
| 2,588,009 | 3/1952 | Jones | 248/224.2 X |
| 2,732,159 | 1/1956 | Connors et al. | 222/180 X |
| 2,926,879 | 3/1960 | Dietrich | 248/223.4 X |
| 3,094,154 | 6/1963 | Daniels | 141/88 |
| 3,270,996 | 9/1966 | Churchill et al. | 248/223.4 |
| 3,327,902 | 6/1967 | Alterwitz | 222/108 |
| 3,928,894 | 12/1975 | Bury et al. | 248/223.4 X |
| 4,623,073 | 11/1986 | Hansen | 221/283 X |

*Primary Examiner*—Kevin P. Shaver

*Attorney, Agent, or Firm*—Flehr, Hohbach, Test, Albritton & Herbert

[57] ABSTRACT

Universal drip catcher for use on different liquid dispensing machines such as water coolers. The drip catcher has a receptacle which is adapted to catch and hold liquid spillage and engage the mounting devices on the different machines for removably mounting the receptacle on the machines.

4 Claims, 3 Drawing Sheets

UNIVERSAL DRIP CATCHER

This invention pertains generally to machines for dispensing liquids such as water, and more particularly to a universal drip catcher for use with a plurality of different machines.

Machines for dispensing water and other liquids generally require some means for catching drips and other spillage which may occur as the liquid is being dispensed. This means generally comprises a container which must be removed periodically to dispose of the liquid which has accumulated therein. Machines from different manufacturers have different means for mounting the containers, and these containers generally are not interchangeable between different types of machines.

It is in general an object of the invention to provide a new and improved drip catcher for use in liquid dispensing machines.

Another object of the invention is to provide a drip catcher of the above character which can be employed in a plurality of different types of liquid dispensing machines.

These and other objects are achieved in accordance with the invention by providing a universal drip catcher having a receptacle adapted to catch and hold liquid spillage and means engageable with the mounting devices on a plurality of different types of liquid dispensing machines for removably mounting the receptacle on the different machines.

Figure 1:
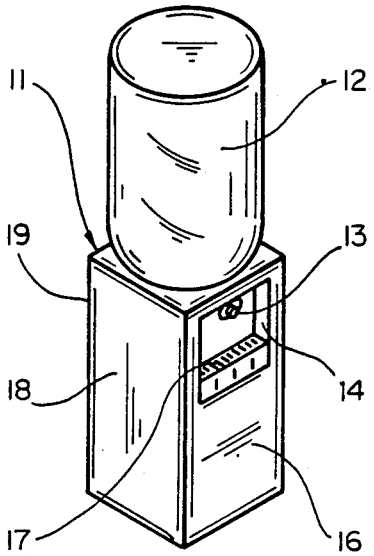
FIG 1 (PRIOR ART)
FIG. 1 is an isometric view of one embodiment of a prior art water dispensing machine in which a universal drip catcher according to the invention can be employed.

The water dispensing machine illustrated in FIG. 1, commonly known as a water cooler, has a generally rectangular base 11 on which a bottle of water 12 is mounted in an inverted position. A dispensing faucet !3 is mounted in a recessed area 14 in the front panel 16 of the base. A grating 17 at the bottom of the recessed area permits water dripping or spilled from the faucet to pass to a drip catcher mounted within the base. The base also has side walls 18 and a rear wall 19. The machine also includes conventional means within the base for cooling the water and routing it from the bottle to the faucet.

Figure 2:
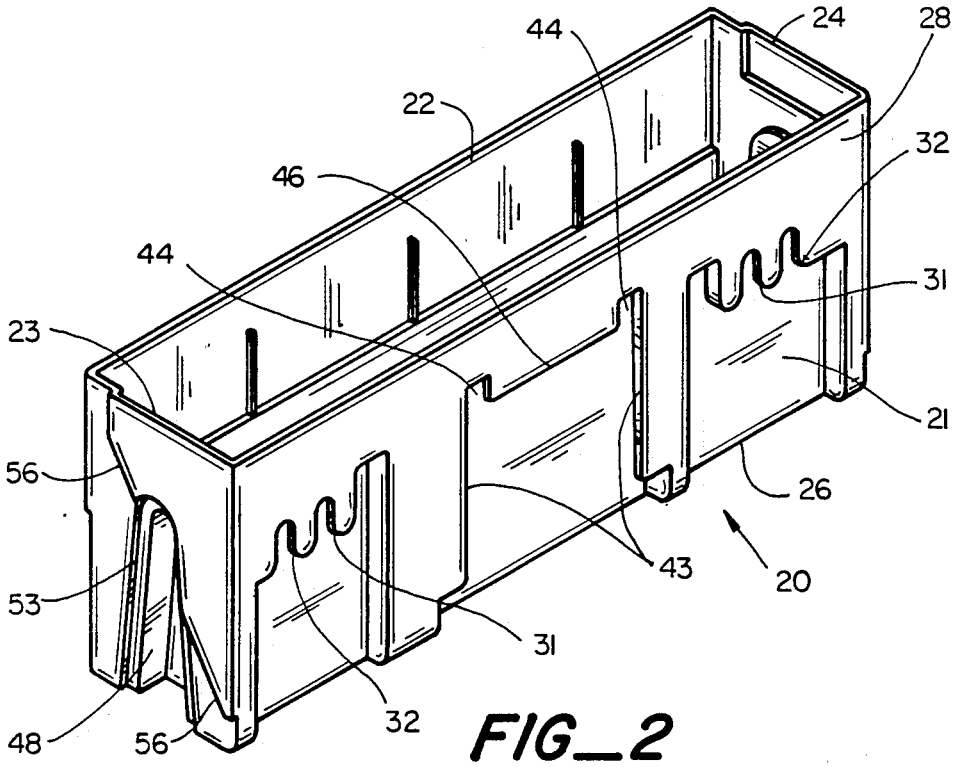
FIG. 2 is a rear isometric view of one embodiment of a universal drip catcher according to the invention.
Figure 3:
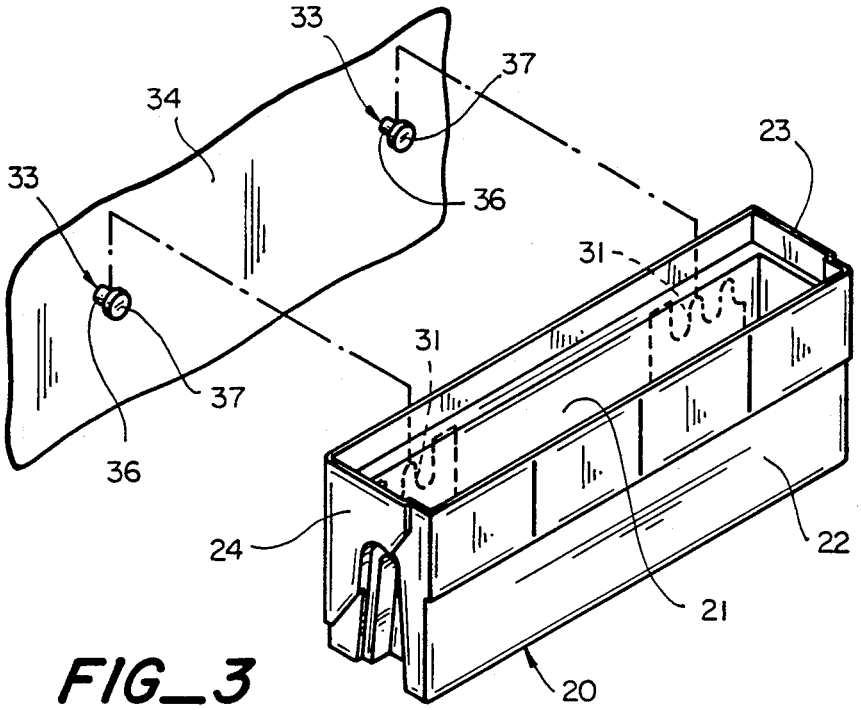
FIGS. 3–6 are isometric views illustrating installation of the drip catcher of FIG. 2 in different types of liquid dispensing machines.

The drip catcher 20 illustrated in FIG. 2 can be employed in the water cooler of Figure 1 as well as in a variety of other liquid dispensing machines. The drip catcher comprises a generally rectangular receptacle which is adapted to catch and hold water or other liquid spillage. The receptacle is open at the top and has side walls 21, 22, end walls 23, 24 and a bottom Wall 26. As discussed hereinafter in detail, means is formed integrally with the receptacle for cooperative engagement with the mounting devices on a plurality of different liquid dispensing machines for mounting the receptacle on such machines in position to catch drips and other liquid spillage therein The mounting means includes a flange 28 which is spaced outwardly from side wall 21 and is generally parallel to the side wall. A pair of downwardly opening slotted openings 31 are formed in the mounting flange for receiving the mounting pins or posts employed in some types of liquid dispensing machines. As illustrated in FIG. 3, the mounting pins 33 project from a vertical mounting surface 34 such as the back side of front panel 16 in the water cooler of FIG. 1. Each of the mounting pins has a relatively short shank 36 with an enlarged head 37 at the outer end of the post. The spacing between slotted openings 31 corresponds to the spacing between pins 33, and the width of the slots corresponds to the diameter of the pins. The drip catcher is mounted in this type of machine by hanging it on the mounting pins, with the shanks of the pins being received in the slotted openings and the enlarged heads of the pins being received in the space between the mounting flange and side wall 21 of the receptacle. The drip catcher is thus installed and removed by a simple vertical movement of the device.

A second pair of slotted openings 32 is also formed in mounting flange 28. These openings are similar to openings 31, but they are spaced farther apart, and they permit the drip catcher to be utilized in machines having different mounting pin spacings.

Figure 4:
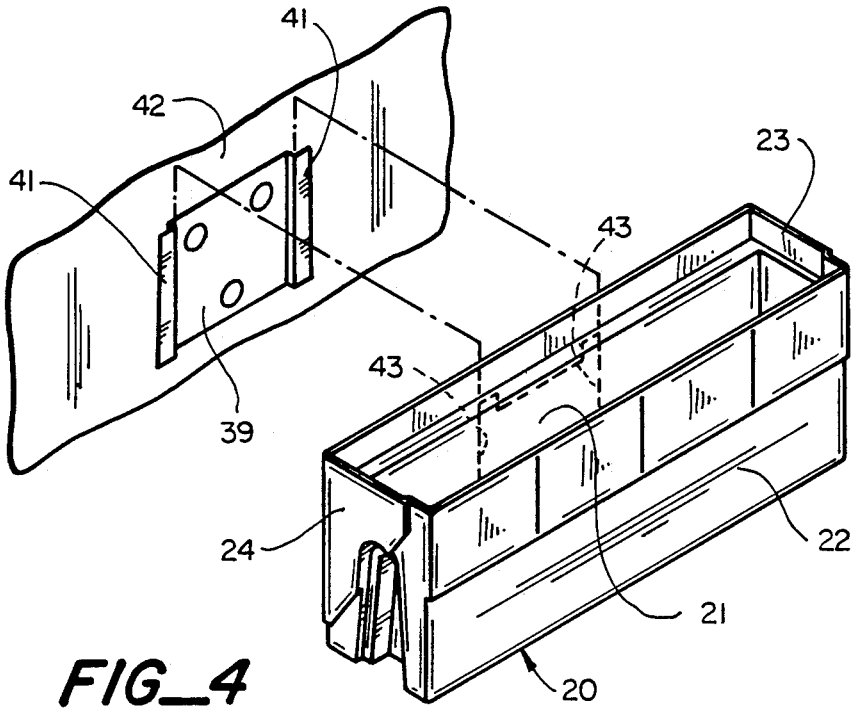

Mounting flange 28 is also formed for engagement with a mounting bracket 39 having a pair of vertically extending flanges 41, as illustrated in FIG. 4. This bracket is mounted on a vertical surface 42 such as the back side of the front panel 16 of the water cooler of FIG. 1, with flanges 41 being spaced from and generally parallel to the mounting surface. Receptacle flange 28 has a pair of vertically extending sections 43 which interfit with, flanges 41, with flanges 41 being received in the space between flange 28 and the side wall 21 of the receptacle. Downward movement of the drip catcher is limited by horizontal shoulders 44 at the upper ends of flange sections 43, which engage the upper edge of mounting bracket 39.

Mounting flange 28 also includes a downwardly extending central section 46 by which the drip catcher can be hung on a horizontally extending mounting bracket or flange (not shown) on certain types of liquid dispensing machines.

Figure 5:
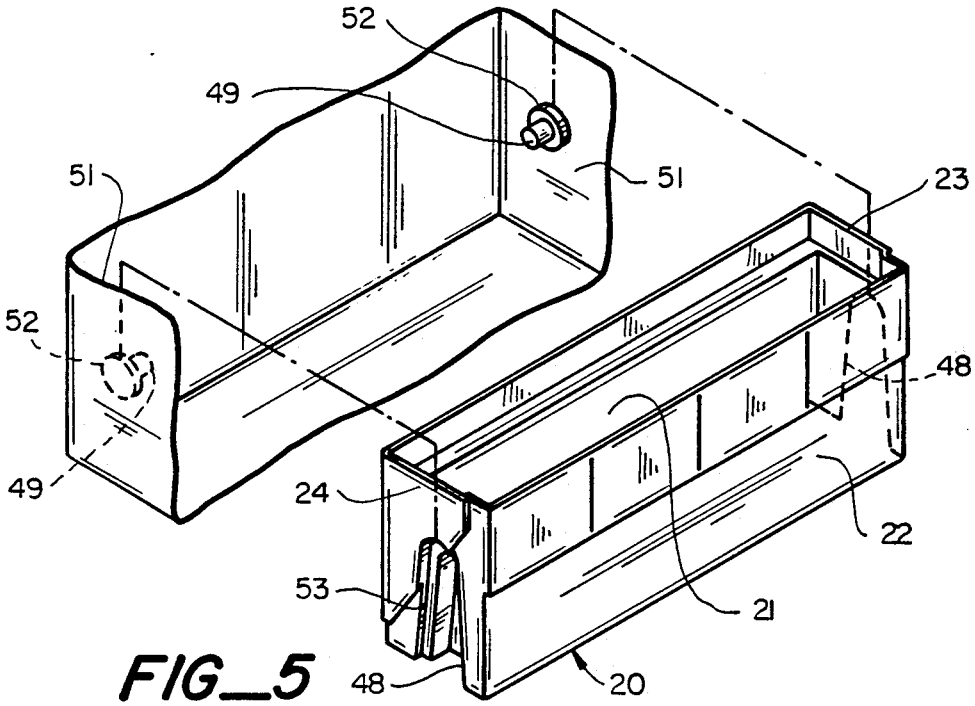

End walls 23, 24 are formed with downwardly opening, V-shaped slots 48 which are adapted to receive longitudinally projecting mounting pins on some types of liquid dispensing machines. As illustrated in FIG. 5, these mounting pins are mounted on a pair of vertically extending mounting surfaces 51 such as the inner sides of side walls 18 in the water cooler of FIG. 1. These mounting pins have bases 52 of enlarged diameter, and the outer portions of openings 48 are relieved to accommodate the bases.

Figure 6:
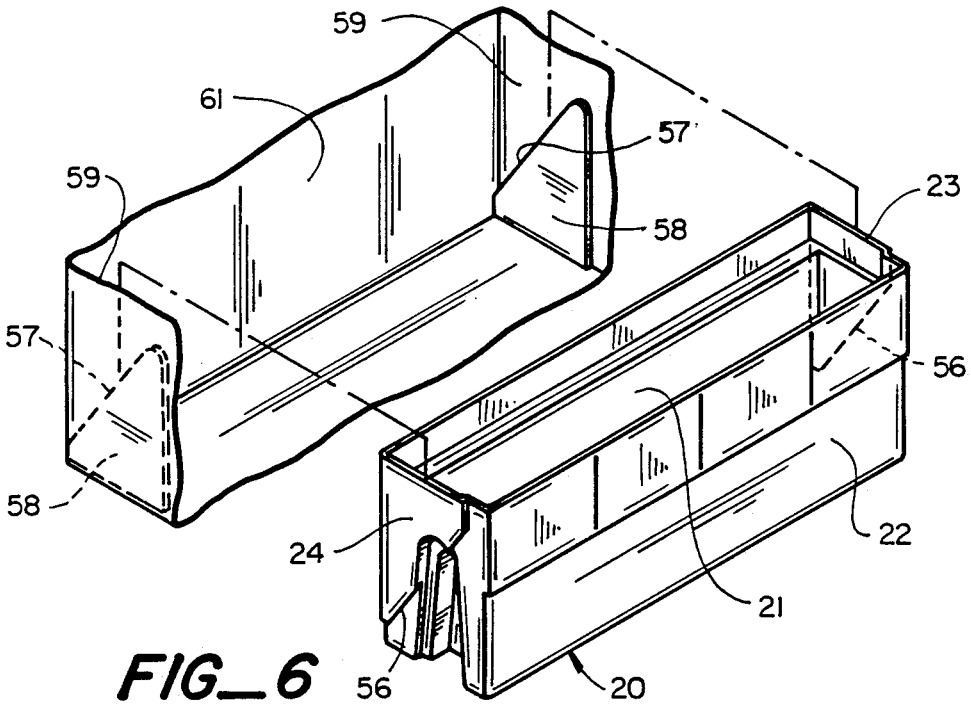

End walls 23, 24 are also formed to include downwardly facing inclined shoulders 56 which are adapted for engagement with upwardly facing inclined shoulders 57 on certain types of liquid dispensing machines, as illustrated in FIG. 6. Shoulders 57 are formed on mounting blocks 58 which are mounted on vertical surfaces 59 such as the inner sides of side walls 18 in the water cooler of FIG. 1. Shoulders 57 terminate at a vertical surface 61 such as the back side of the front panel in the water cooler of Figure 1. Shoulders 56 and 57 slope in a downward direction toward walls 21 and 61, respectively, and wall 61 serves as a limiting abutment for the drip catcher when it is mounted on blocks 58. As in the previous figures, the drip catcher is installed on and removed from mounting blocks 58 with a simple vertical movement.

Drip catcher 20 is formed as an integral structure, and in one presently preferred embodiment, it is fabricated of plastic and formed by injection molding.

The drip catcher has a number of important features and advantages. It is relatively inexpensive to manufacture, and it can be employed in a wide variety of different types of liquid dispensing machines.

It is apparent from the foregoing that a new and improved drip catcher has been provided for use in liquid dispensing machines. While only certain presently preferred embodiments have been described in detail, as will be apparent to those familiar with the art, certain changes and modifications can be made without departing from the scope of the invention as defined by the following claims.

We claim:

1. In a universal drip catcher for use with a plurality of different liquid dispensing machines having different means for attachment of a container for catching liquid spillage: a generally rectangular receptacle having end and side walls and being open at the top, a flange spaced outwardly from one of the side walls and having downwardly facing openings for receiving mounting pins and mounting brackets on machines having mounting pins and mounting brackets with portions of the mounting pins and mounting brackets being received in the space between the flange and the side wall of the receptacle, downwardly opening V-shaped slots at the ends of the receptacle for receiving longitudinally projecting mounting pins on machines having longitudinally extending mounting pins, downwardly facing inclined shoulders at the ends of the receptacle for engagement with upwardly facing inclined shoulders on machines having upwardly facing inclined shoulders, and means for limiting downward movement of the shoulders on the receptacle relative to the shoulders on the machines to hold the receptacle in a predetermined position on the machine when the shoulders are engaged.

2. The drip catcher of claim 1 wherein the downwardly facing openings in the flange include a plurality of slotted openings.

3. The drip catcher of claim 2 wherein the slotted openings are arranged in pairs positioned to receive mounting pins on different machines.

4. The drip catcher of claim 1 wherein the means for limiting downward movement includes a vertical surface on one side of the receptacle toward which the inclined surfaces sloped in a downward direction.

* * * * *